US006017245A

United States Patent [19]

Karir

[11] Patent Number: 6,017,245

[45] Date of Patent: Jan. 25, 2000

[54] STAMPED BACKSHELL ASSEMBLY WITH INTEGRAL FRONT SHIELD AND REAR CABLE CLAMP

[75] Inventor: Arvind Karir, Toronto, Canada

[73] Assignee: Amphenol Corporation, Wallingford, Conn.

[21] Appl. No.: 09/136,370

[22] Filed: Aug. 19, 1998

[51] Int. Cl.[7] ..... H01R 9/03

[52] U.S. Cl. ..... 439/610; 439/607

[58] Field of Search ..... 439/607, 609, 439/610

[56] References Cited

U.S. PATENT DOCUMENTS

| | | | |
|---|---|---|---|
| 2,519,726 | 8/1950 | Wollard . | |
| 3,375,481 | 3/1968 | Parnell . | |
| 3,909,101 | 9/1975 | Bruels . | |
| 4,272,148 | 6/1981 | Knack, Jr. . | |
| 4,293,180 | 10/1981 | Taylor . | |
| 4,363,531 | 12/1982 | Lancaster . | |
| 4,486,724 | 12/1984 | Schofield . | |
| 4,640,984 | 2/1987 | Kalbfeld . | |
| 4,689,723 | 8/1987 | Myers et al. . | |
| 4,786,260 | 11/1988 | Spaulding . | |
| 4,789,256 | 12/1988 | Nishino et al. . | |
| 4,822,304 | 4/1989 | Herron . | |
| 4,846,724 | 7/1989 | Sasaki et al. . | |
| 4,854,890 | 8/1989 | Nishimura . | |
| 4,921,441 | 5/1990 | Sauder . | |
| 4,963,104 | 10/1990 | Dickie . | |
| 5,052,949 | 10/1991 | Lopata et al. | 439/610 |
| 5,055,070 | 10/1991 | Plegge et al. . | |
| 5,108,294 | 4/1992 | Marsh et al. . | |
| 5,195,909 | 3/1993 | Huss, Jr. et al. . | |
| 5,244,415 | 9/1993 | Marsilio et al. . | |
| 5,364,292 | 11/1994 | Bethurum . | |
| 5,380,223 | 1/1995 | Marsh et al. | 439/610 |
| 5,505,637 | 4/1996 | Krämer et al. . | |
| 5,797,771 | 8/1998 | Garside | 439/610 |
| 5,820,412 | 10/1998 | Koegel et al. | 439/610 |

*Primary Examiner*—M. L. Gellner
*Assistant Examiner*—Antoine Ngandjui
*Attorney, Agent, or Firm*—Bacon & Thomas

[57] ABSTRACT

A shielding arrangement for an connector includes a housing made up of a base and front shield stamped and formed from a single blank to provide shielding continuity between the front shield and a cable gripping section of the base. A cover is arranged to be secured to the base using only two screws, the cover being secured to the base by interengaging tabs at the front of the cover, the two screws, and an injection molded plastic insulator that fits over the assembled base and cover and that includes retention for jackscrews using interference holes on two sides of the insulator and provision for securing a separate strain relief.

21 Claims, 2 Drawing Sheets

STAMPED BACKSHELL ASSEMBLY WITH INTEGRAL FRONT SHIELD AND REAR CABLE CLAMP

BACKGROUND OF THE INVENTION

1. Field of the Invention

This invention relates to an electrical connector shell, and in particular to a connector shell having an integrated backshell, front shield, and rear cable clamp so as to provide a continuous ground path between the front mating end of the shell and the cable shielding. The invention also relates to an electrical connector including an integrated stamped sheet metal backshell, D-shell front mating end, and rear cable clamp, a stamped metal top cover, and an injection molded insulator, and to a method of assembling such a connector.

2. Discussion of Related Art

The invention addresses the problem of ensuring shielding continuity at the connections between a cable of the type used in computing applications to carry high frequency data in order to prevent radiation leakage and provide all around protection from electromagnetic interference. The cables with which the present invention is concerned are the type which include multiple individual wires surrounded by a braided outer conductor, the outer conductor effectively shielding the individual wires of the cable. Connection of the cable is accomplished by terminating individual electrical connections to connector contacts surrounded by a metal shell, the metal shell being electrically connected at the rear to the braided outer conductor of the cable, and at the front to a shield that surrounds the connector contacts and establishes an electrical connection to the shell or housing of a mating connector or component.

Essentially, there are two areas in a conventional shielded cable connection where shielding continuity may be interrupted. The first is at the seam between the metal backshell which houses the cable termination and the front shield which surrounds the contacts and establishes electrical contact with the corresponding mating connector or component, and the second is at the interface between the cable clamp at the rear of the connector and the cable shield.

One solution to the problem of discontinuities at the seam between the metal shell and the front shield is disclosed in commonly assigned copending application Ser. No. 08/788,777, filed Jan. 24, 1997. The copending application teaches the concept of integrating the front shield and backshell by die casting the front shield together with the backshell to form a unitary structure. However, while the shielding continuity provided by this structure is superior to that provided by conventional connectors of the same general type, there are situations where stamped metal backshells are preferable to die cast backshells. As a result, the invention seeks to apply the concept of an integral front shield and cable clamp disclosed in the copending application to a stamped metal connector shell rather than a die cast connector shell. In addition, although the connector described in the copending application is relatively simple to assemble, the present invention further reduces and simplifies the steps necessary to assemble the connector.

The related problem of eliminating shielding discontinuities at the interface between the backshell and the rear cable clamp of the conventional connector has also been addressed in commonly assigned copending application Ser. No. 08/788,777. However, the context is again that of a die cast metal connector shell, in which cable gripping teeth can be cast directly into the passage through which the cable enters the rear of the backshell. Another die cast connector shell with integral cable gripping structures, but without an integral front shield, is also disclosed in U.S. Pat. No. 5,244,415.

In the case of stamped metal connectors, the most typical arrangement is that illustrated, by way of example, in U.S. Pat. No. 5,055,070, which discloses a connector shell made of a separate front shield, connector retaining backshell, and back shield/cable clamp, the connector shell being overmolded after assembly.

There are of course electrical connectors in which a mating front portion is integral with the rear portion of the connector, including cylindrical connectors, BNC connectors, and so forth. However, connectors of the type with which the present invention is concerned have consistently used a separate shield, as described in numerous patents, including the '415 patent and U.S. Pat. Nos. 4,678,256, 4,689,728, 4,786,260, 4,822,304, 44,854,890, 4,921,441, and 5,108,294, all of which disclose cable connectors having discrete or separate trapezoidal shield arrangements, rather than integral front shields, and which therefore cannot provide optimal electrical continuity between the outer conductor of the cable and the shield.

In summary, none of the prior connector arrangements suggests a cable connector of the type having both a stamped metal shell to which the outer braid of the cable is electrically connected and a front contact shield, which is capable of providing a continuous low resistance electrical ground path from the outer cable conductor all the way to the shield, with no seams and thus optimal electrical properties, and which eliminates the need for a dielectric contact support structure. In all of the prior connectors of the type with which the invention is concerned, the front shield is a discrete structure from the metal shell, and while a connector shell without any seams between the rear cable clamp and the front shield is disclosed in copending U.S. patent application Ser. No. 08/788,777, the connector shell of the copending application is a die cast metal shell rather than a stamped metal shell, and none of the other references listed above contains any teachings of suggests of providing similarly front shield to rear cable clamp continuity in a stamped metal connector shell.

SUMMARY OF THE INVENTION

It is accordingly an objective of the invention to provide an electrical connector shell that provides a continuous low resistance ground path from the outer braid of an electrical cable to a shield of the connector, and in particular a stamped metal electrical connector shell that provides such a continuous low resistance ground path.

It is also an objective of the invention to provide an electrical connector of the type which includes a metal shell to which the outer braid of a multiple wire cable is electrically connected, and a front shield with polarizing properties surrounding the connector contacts, and which nevertheless provides a continuous seamless ground path from the cable termination to the front shield to thereby reduce EMI/RF leakage at the interface between the front shield and the metal shell.

It is yet another objective of the invention to provide an electrical connector of the type having a metal shell to which the outer braid of a cable is terminated, and a metal shield surrounding the contacts, and in which establishment of the ground path from the cable braid to the front shield is accomplished by simply fastening a cover to a base portion of the connector, without the need to separately assemble the shield to the metal shell or to use a cable terminating clamp or other cable gripping member.

Finally, it is also an objective of the invention to provide a simplified method of assembling an electrical connector shell that includes a front shield electrically connected to outer shielding of a cable terminated to contacts in the connector, the simplified method involving the steps of terminating wires in the cable to contacts in the connector and attaching a cover to a backshell of the connector by means of just two screws in order to clamp the cable and electrically connect the outer shielding of the cable to the front shield of the connector.

These objectives are achieved, in accordance with the principles of a preferred embodiment of the invention, by providing a shielded connector having a housing made up of a stamped and formed base and cover, and an integral polarizing-type front shell rather than a separate front shell, and by modifying the braid termination structure of the conventional shielded multiple conductor connector by including in the stamped and formed base and cover an integral cable gripping clamp. In addition, the preferred embodiment of the invention includes an injection molded plastic insulator that incorporates features for latching the backshell and top cover, and retention for jackscrews using interference holes on two sides of the insulator.

It will be appreciated that the backshell of the preferred embodiment of the invention can easily be manufactured using known techniques, such as by using drawn steel processes to form the blank as a seamless trapezoidal front shield portion and an appropriately shaped planar section that is then folded to form an integral base for the backshell.

Not only does this structure achieve the advantages of improved shielding continuity between the cable braid and the front shell while at the same time simplifying assembly of the connector, but because the front shield is integral with the metal shell, the overall profile of the backshell and connector can be reduced.

Although a single preferred embodiment of the invention is disclosed in detail, those skilled in the art will appreciate that numerous additional modifications of the disclosed embodiments may be made without departing from the scope of the invention, for example as relates to the wire termination and contact structures and the shapes of the metal shell and shield, and that the invention is intended to include all such modifications.

DETAILED DESCRIPTION OF THE PREFERRED EMBODIMENTS

Figure 2:
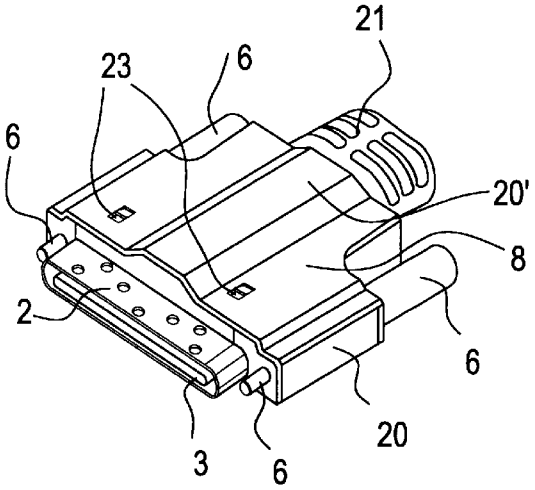
FIG. 2 is an isometric view of the electrical connector of the preferred embodiment, after assembly of the connector.
Figure 3:
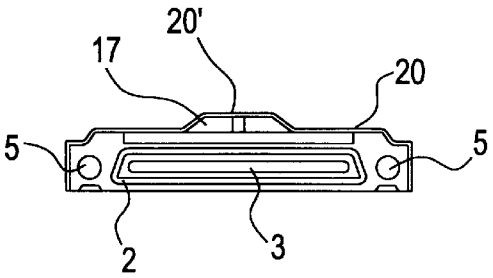
FIG. 3 is a front view of the electrical connector of the preferred embodiment.
Figure 1:
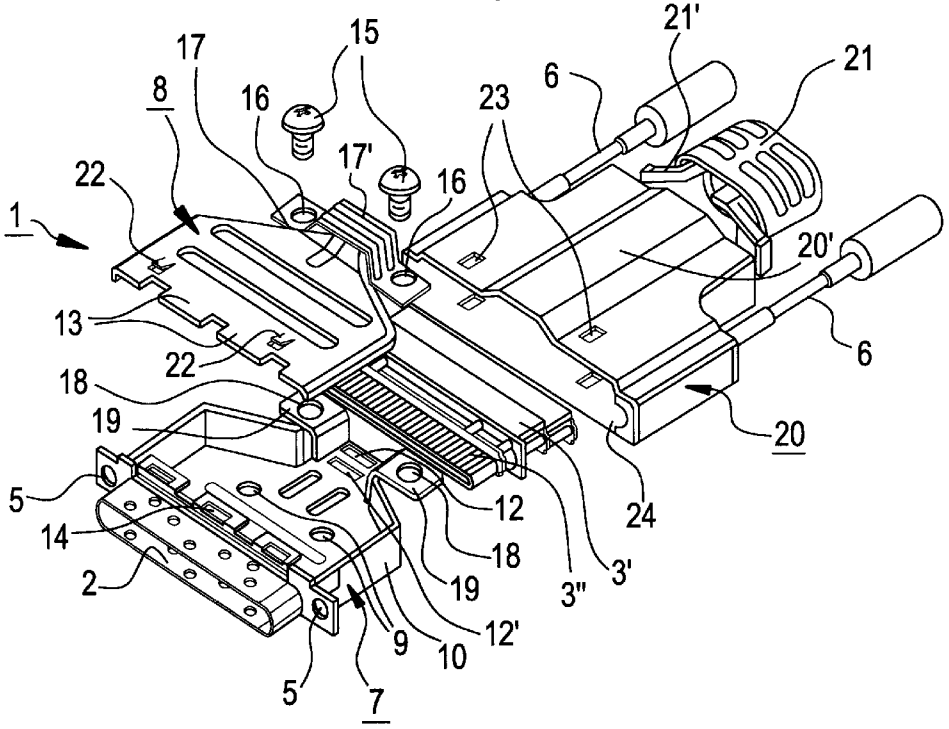
FIG. 1 is an isometric view of the various components of an electrical connector constructed in accordance with the principles of a preferred embodiment of the invention, before assembly of the connector.

As illustrated in FIGS. 1–5, the electrical connector of the preferred embodiment of the invention includes a stamped metal backshell 1 and a front shield 2 extending forwardly of the backshell to surround an insert sub-assembly containing a contact grid 3".

The shield 2 is a arranged to fit within a correspondingly shaped opening in a mating connector or component, the shape of the shield serving to polarize the connector to prevent improper orientation relative to the mating connector or component upon mating. Generally, a trapezoidal or "D" shape is used to provide polarization, although the front shield could also have other shapes. In addition, the shield could be arranged without a preferred orientation with polarization being provided by keys on the connector. As illustrated, the preferred connector conforms to the VHDCI standard, although connectors other than VHDCI connectors may of course fall within the scope of the invention.

In the illustrated connector, the backshell 1 forms a chamber into which the insert sub-assembly 3 extends, and within which the individual wires 4" of a cable 4 are terminated to the contact grid 3". In addition, the backshell includes openings 5 for permitting passage of means for securing the connector to a mating connector, panel, or other structure, which in the illustrated embodiment are jackscrews 6 arranged to pass through openings 5 and to extend between the sides of the backshell and a plastic outer cover, as will be described in more detail below. Although the illustrated embodiment uses screws, however, those skilled in the art will appreciate that other types of latches may be substituted for the illustrated screws.

The illustrated contact assembly, including insert sub-assembly 3 and insert assembly 3', may be conventional, or it may use the insert sub-assembly structure disclosed in copending U.S. patent application Ser. No. 08/788,777. Preferably, the dielectric insert assembly that holds the insert sub-assembly is arranged to snap into the backshell, although more conventional arrangements for securing the insert sub-assembly could also be used.

As is also conventional, the backshell 1 is made up of a base 7 and cover 8, with the base forming the bottom of the backshell as well as sidewalls 10, and the cover 8 forming the top. Unlike the conventional connector, however, the front shield is stamped and formed integrally with the base, from a single piece of sheet metal. It will be appreciated by those skilled in the art that stamping and forming techniques are well-known in the art, and that the shape of the blank and appropriate fold lines will depend on the exact shape of the final connector and can be varied as necessary. However, one common method of forming a D-shaped shield together with attachment flanges is to form the blank of drawn steel, thereby eliminating seams in the shield, and allowing the shield to be connected to the backshell. This technique is mentioned, for example, in U.S. Pat. No. 4,786,260, in connection with a separate stamped and formed front shield structure. In the preferred embodiment of the invention, the well-known technique is modified so that the drawn steel blank includes the front shield and extensions from which the base 7 and the various illustrated flanges and extensions can be formed, but the basic stamping and forming steps are not otherwise varied.

In order to simplify assembly of the insert assembly 3' within the base 7, projections 9 are formed in the base and arranged to hold the insert assembly in place upon insertion of the insert sub-assembly 3 and contact grid 3" through the opening at the front of the base 7 and pressing down on the insert assembly 3' so that the projections 9 engage the rear of the insert assembly and thereby hold the insert assembly in place by preventing the insert sub-assembly from being pushed rearwardly through the opening. Upon securing the insert assembly within the connector, the cable extends through a passage 12 formed at the rear of the base and is secured in the opening when the top cover 8 is secured to the base.

While the cover 8 may be secured to the base 7 in a variety of ways without departing from the scope of the invention, an especially preferred arrangement is to provide interengageable means at the front of the cover and base so that the front of the cover can be temporarily secured to the base during assembly without additional fasteners, the cover being permanently secured to the base upon fastening of the rear of the cover to the base, thereby minimizing the number of required fastening steps. By way of example, the fastening means could be in the form of tabs 13 that fit under flanges 14 extending from the base above the front shield to thereby secure the front of the top cover when the rear of the top cover is screwed to the base. Alternatively, tabs, hooks, or the like on either the cover or the base could be arranged to fit into corresponding slots or extensions in either the base or the cover to accomplish the same function of securing the front of the cover to the base while the rear of the cover is being secured to the base by external fasteners.

In the illustrated example, permanent fastening of the cover 8 to the base 7 is by means of screws 15 which pass through openings 16 in a cable gripping extension 17 of the cover, and through openings 18 in flanges 19 extending from the rear of base 7 adjacent the cable passage 12 and to be secured by nuts or other fasteners (not shown). Alternatively, the screws 15 could be arranged to be threaded into openings 18.

Figure 5:
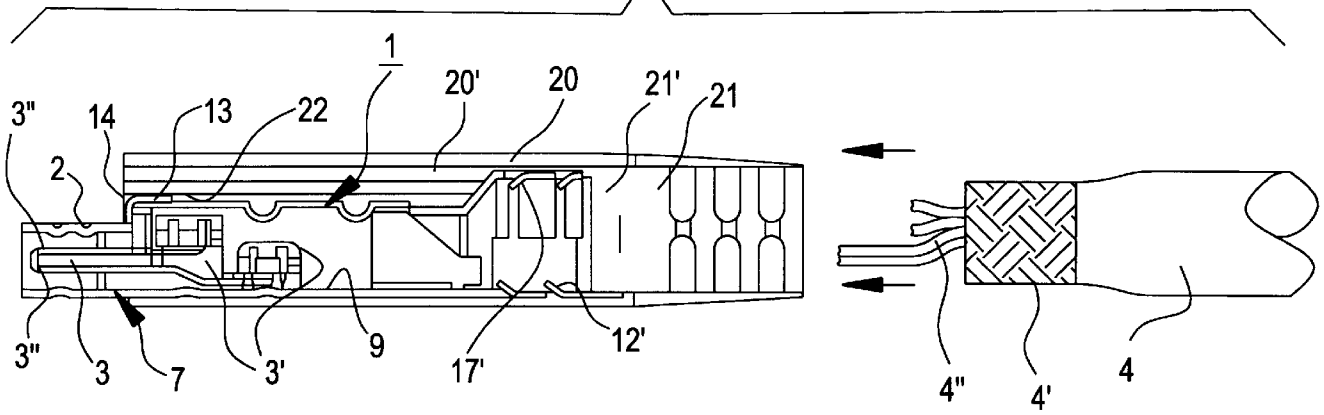
FIG. 5 is a cross-sectional side view of the electrical connector of the preferred embodiment, including a cable terminated thereto.
Figure 4:
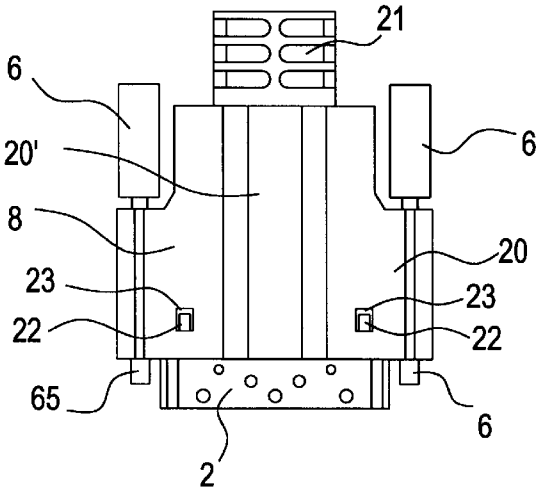
FIG. 4 is a top view of the electrical connector of the preferred embodiment.

The advantage of fastening the cover to the base at the cable gripping portion of the base is that fastening of the cover to the base accomplishes the added function of compressing the shield of a cable, whose individual wires have already been terminated to the insert sub-assembly 3, between the respective cable gripping sections of the cover and base, thereby permitting the cover to be attached to the base and the cable to be gripped in a single fastening operation, using just two screws or like fasteners. As is best shown in FIG. 5, the cable gripping section 17 and passage 12 preferably have formed therein tabs 17' and 12' which grip the cable shield 4' upon securing the cover to the base, following termination of individual wires 4" to the insert assembly 3'.

In order to provide a completed connector, the backshell of the preferred embodiment of the invention may be enclosed within a plastic insulator 20 made, for example, of injection molded insulating plastic. As illustrated, the plastic insulator includes a molded-in raised portion 20' that permits the insulator to clear the cable gripping extension 17 during assembly of the insulator to the backshell and a separate cable strain relief 21 including arms 21' arranged to snap into the plastic insulator, with the interior of the insulator being shaped to fit tightly over the backshell and thereby help secure cover 8 to base 7. Although the strain relief is illustrated as being separate from the plastic insulator, those skilled in the art will appreciate that the strain relief could also be an integrally molded portion of the plastic insulator.

While the insulator can be secured to the cover by any known securing means, in the illustrated arrangement, the insulator is secured to the backshell by tabs 22 extending from the cover and base (the base tabs are not shown) so as to engage openings 23 in the insulator and prevent the insulator from being pulled off the backshell in a rearward direction.

Finally, the insulator includes interior grooves 24 for accommodating jackscrews 6, the grooves being sized to provide an interference fit for the shafts of the screws between the insulator and base 7, and help retain the screws prior to attachment to a mating connector or component, and in addition prevent loosening of the screws after attachment.

The method of the invention, as will be apparent tho those skilled in the art based on the above, involves the steps of installing an insert sub-assembly or cable termination fixture in the base, stripping an outer jacket of the cable to expose the braided outer shield, further stripping the jacket and braided shield to expose individual wires of the cable, terminating the wires to the insert sub-assembly or termination fixture, positioning the cover such that the front of the cover is secured by interengaging tabs or the like to the front of the base, using two screw to attach the cover to the base with the cable positioned in the entry passage such that, as the cover is attached to the base, the braided shield of the cable is gripped to establish shielding continuity between the cable and the backshell, and finally sliding a plastic insulator and strain relief, through which the cable had been inserted prior to assembly, over the backshell and inserting the jackscrews into a passage formed between the backshell and the plastic insulator to complete assembly.

Having thus described various preferred embodiments of the invention, and variations of those embodiments, those skilled in the art will appreciate that further variations and modifications of the preferred embodiments may be made without departing from the scope of the invention. It is accordingly intended that the invention not be limited by the above description or accompanying drawings, but that it be defined solely in accordance with the appended claims.

I claim:

1. A stamped and formed metal shielding arrangement for an electrical connector, comprising:

a backshell made up of a base and a cover which form a chamber in which wires of a cable are terminated and a passage at a rear of the chamber through which the cable enters the chamber; and a front shield which surrounds mating ends of a set of electrical contacts, wherein said front shield is stamped and formed together with said base from a single blank to form a single seamless member that provides continuous shielding between a cable shield and said contacts.

2. An arrangement as claimed in claim 1, further comprising interengaging means at a front of said base and at a front of said cover, said interengaging means engaging each other during assembly of the backshell to partially secure the cover to the base, the cover further being secured to the base by fastening means at the rear of the cover and base.

3. An arrangement as claimed in claim 1, wherein said interengaging means includes interengaging tabs on said cover and base, and wherein said fastening means comprises two screws arranged to pass through holes in a cable gripping portion of the cover, fastening of the cover to the base simultaneously causing compression of the cable shield in order to ensure a continuous electrical connection between the cable shield and backshell.

4. An arrangement as claimed in claim 1, wherein said two screws are the only screws required to assemble the cover to the base and to grip the cable shield.

5. An arrangement as claimed in claim 1, wherein said backshell further includes tabs for permitting an insert sub-assembly insert to be snapped into the base.

6. An arrangement as claimed in claim 1, wherein said cover includes tabs for securing a plastic insulator to the cover.

7. An arrangement as claimed in claim 1, wherein said front shield extends forwardly from a front wall of said backshell and surrounds a contact grid to which said wires of said cable are terminated, and wherein said front shield has a trapezoidal shape.

8. An electrical connector, comprising;

electrical contacts arranged to be terminated to wires of a cable;

a shielding arrangement; and a plastic insulator surrounding said shielding arrangement, wherein the shielding arrangement comprises:

a backshell made up of a base and a cover which form a chamber in which said wires of the cable are terminated and a passage at a rear of the chamber through which the cable enters the chamber; and a front shield which surrounds mating ends of said electrical contacts, wherein said front shield is stamped and formed together with said base from a single blank to form a single seamless member that provides continuous shielding between a cable shield and said contacts.

9. A connector as claimed in claim 8, further comprising interengaging means at a front of said base and at a front of said cover, said interengaging means engaging each other during assembly of the backshell to partially secure the cover to the base, the cover further being secured to the base by fastening means at the rear of the cover and base.

10. A connector as claimed in claim 8, wherein said backshell further includes tabs for permitting an insert sub-assembly insert to be snapped into the base.

11. A connector as claimed in claim 8, wherein said cover includes tabs and said plastic insulator includes openings for securing the plastic insulator to the cover.

12. A connector as claimed in claim 8, wherein said cover is arranged to fit tightly over said backshell and thereby help secure the cover to the base.

13. A connector as claimed in claim 8, further comprising a cable strain relief arranged to snap into a rear of the plastic insulator.

14. A connector as claimed in claim 8, wherein said plastic insulator includes grooves, and wherein when the plastic insulator is fitted over the backshell, said grooves cooperate with sides of the base to form interference fit passages through which pass jackscrews for securing the connector to a mating connector or component.

15. an arrangement as claimed in claim 8, wherein said front shield extends forwardly from a front wall of said backshell and surrounds a contact grid to which said wires of said cable are terminated, and wherein said front shield has a trapezoidal shape.

16. A connector as claimed in claim 8, wherein said interengaging means includes interengaging tabs on said cover and base, and wherein said fastening means comprises two screws arranged to pass through holes in a cable gripping portion of the cover, fastening of the cover to the base simultaneously causing compression of the cable shield in order to ensure a continuous electrical connection between the cable shield and backshell.

17. A connector as claimed in claim 16, wherein said two screws are the only screws required to assembled the cover to the base and to grip the cable shield.

18. A method of assembling a connector, comprising:

stamping and forming a base and front shield from a single blank;

mounting an insert in the base, the insert including electrical contacts;

terminating wires of a cable to the electrical contacts;

attaching a cover to the base by causing interengaging features at the front of the cover and base to engage and securing to screws to the rear of the cover and base, the screws passing through openings adjacent a cable gripping section of the base and cover to not only secure the cover to the base, but also to compress a shield of the cable and thereby electrically connect the shield to the base and cover.

19. A method as claimed in claim 18, wherein the step of mounting the insert in the base comprising the step of snapping the insert into the base.

20. A method as claimed in claim 18, further comprising the step of sliding a plastic insulator over the base and cover from the rear until interengaging latching features on the cover and insulator engage each other to secure the insulator to the cover, the insulator further securing the cover to the base.

21. A method as claimed in claim 20, further comprising the step of inserting jackscrews through a passage formed between the insulator and side walls of the base.

* * * * *